United States Patent [19]

Knap

[11] 4,152,870

[45] May 8, 1979

[54] SLIDABLE DOOR CLOSURE AND HANGER SYSTEM FOR PASSENGER VEHICLE

[75] Inventor: Joseph Knap, Montreal, Canada

[73] Assignee: Canadair Limited, Montreal, Canada

[21] Appl. No.: 890,314

[22] Filed: Mar. 27, 1978

[30] Foreign Application Priority Data

Jan. 13, 1978 [CA] Canada ..... 294920

[51] Int. Cl.[2] ..... E05F 17/00

[52] U.S. Cl. ..... 49/118; 49/123; 49/360; 49/409

[58] Field of Search ..... 49/123, 118, 360, 409, 49/411, 274

[56] References Cited

U.S. PATENT DOCUMENTS

| | | | |
|---|---|---|---|
| 1,109,202 | 9/1914 | Cossey | 49/409 X |
| 2,808,625 | 10/1957 | Wilkinson | 49/274 |
| 3,089,203 | 5/1963 | Roselius | 49/409 |
| 3,439,454 | 4/1969 | Stretton | 49/123 X |
| 3,470,652 | 10/1969 | Forbes | 49/360 X |
| 3,727,349 | 4/1973 | Bainbridge | 49/411 |

FOREIGN PATENT DOCUMENTS

| | | | |
|---|---|---|---|
| 571068 | 2/1933 | Fed. Rep. of Germany | 49/411 |

*Primary Examiner*—Philip C. Kannan
*Attorney, Agent, or Firm*—A. Lebrun

[57] ABSTRACT

A system consisting of a door closure and door hanger which are integrated to achieve improved operation and simple construction and particularly characterized by a single action pneumatic cylinder and an internal return spring coiled around the piston rod to achieve pneumatic opening of the sliding doors and spring closing of the latter respectively in combination with novel track units featuring removing the load on the balls when the doors are in closed position and shorter track units less subject to longitudinal deflection of the passenger vehicle. The return spring is taken advantage of to produce unhurting impact and closure force at the end of the closing course and to eliminate the sealing requirements around the piston rod at the corresponding end of the pneumatic cylinder. The slide track units include a pair of movable door carrier track members to which are attached the doors respectively, the piston rod, and an interconnecting cable allowing removal of the doors without disturbing the setting or mounting of the door closure and hanger system.

6 Claims, 5 Drawing Figures

SLIDABLE DOOR CLOSURE AND HANGER SYSTEM FOR PASSENGER VEHICLE

FIELD OF THE INVENTION

This invention relates to a door closure for slidable doors and more particularly to a slidable door closure and hanger system in particular of the type adapted for the sliding doors of a passenger vehicle or rapid transit passenger car.

DESCRIPTION OF THE PRIOR ART

The closing and opening of such oppositely sliding doors have so far been given special considerations to ensure reliable, safe, and lasting operation thereof. For instance, the pneumatic or hydraulic circuit operating the doors have been made to achieve rapid closing of the doors in combination with a slower speed of closing at the end of the closing course for the safety of passengers which could be hit by the doors. So far, such slower closing speed has been obtained with a resultant increase in complexity. Double action actuation cylinders have been proposed so far to operate the doors but such cylinder rapidly presents leakage at the piston rod end thereof due to wearing out of the seal around the piston rod.

The handing of oppositely sliding doors has so far been done on continuous tracks with the required span to accommodate the door open and door closed positions. The sliding medium are the same rollers or balls which must resist inertia and vibratory loads when car is in motion with doors closed and which must also resist inertia loads during door open and close cycle. The long open tracks are subject to the deposit of contaminants on the rolling surfaces and to induced deflections by the wall of the carbody; both being main sources of door jamming.

SUMMARY OF THE INVENTION

It is a general object of the present invention to provide a slidable door closure and hanger system of the above type which produces in a simple and reliable manner a closing force unhurting the body of a user at the end of the closing course.

It is another object of the present invention to provide a slidable door closure and hanger system of the above type which takes advantage of the decreasing force of a spring as it approaches the end of its active course to provide the unhurting closing force on the slidable doors.

It is a further object of the present invention to provide a slidable door closure and hanger system of the above type with a single action pneumatic cylinder and to thereby avoid sealing problems around the piston rod and undue wear of or by the latter, and to simultaneously protect the spring against soiling, tampering therewith, and other problems associated with external mounting thereof.

It is still another object of the present invention to provide a slidable door closure and hanger system of the above type wherein the door closure and hanger constitute an integrated combination which allows removal of the doors without any risk of impairing the accuracy, setting, or operative relationship between the movable components.

It is a more explicit object of the present invention to provide a slidable door closure and hanger system of the above type wherein the door closure and the door hanger remain interconnected by a pair of undisturbed movable slide track members when the doors are removed to avoid difficulties in reinstalling the doors.

BRIEF DESCRIPTION OF THE DRAWINGS

The above and other objects and advantages of the present invention will be better understood with reference to the following detailed description of a preferred embodiment thereof which is illustrated, by way of example, in the accompanying drawings; in which.

DESCRIPTION OF THE PREFERRED EMBODIMENT

Figure 1:
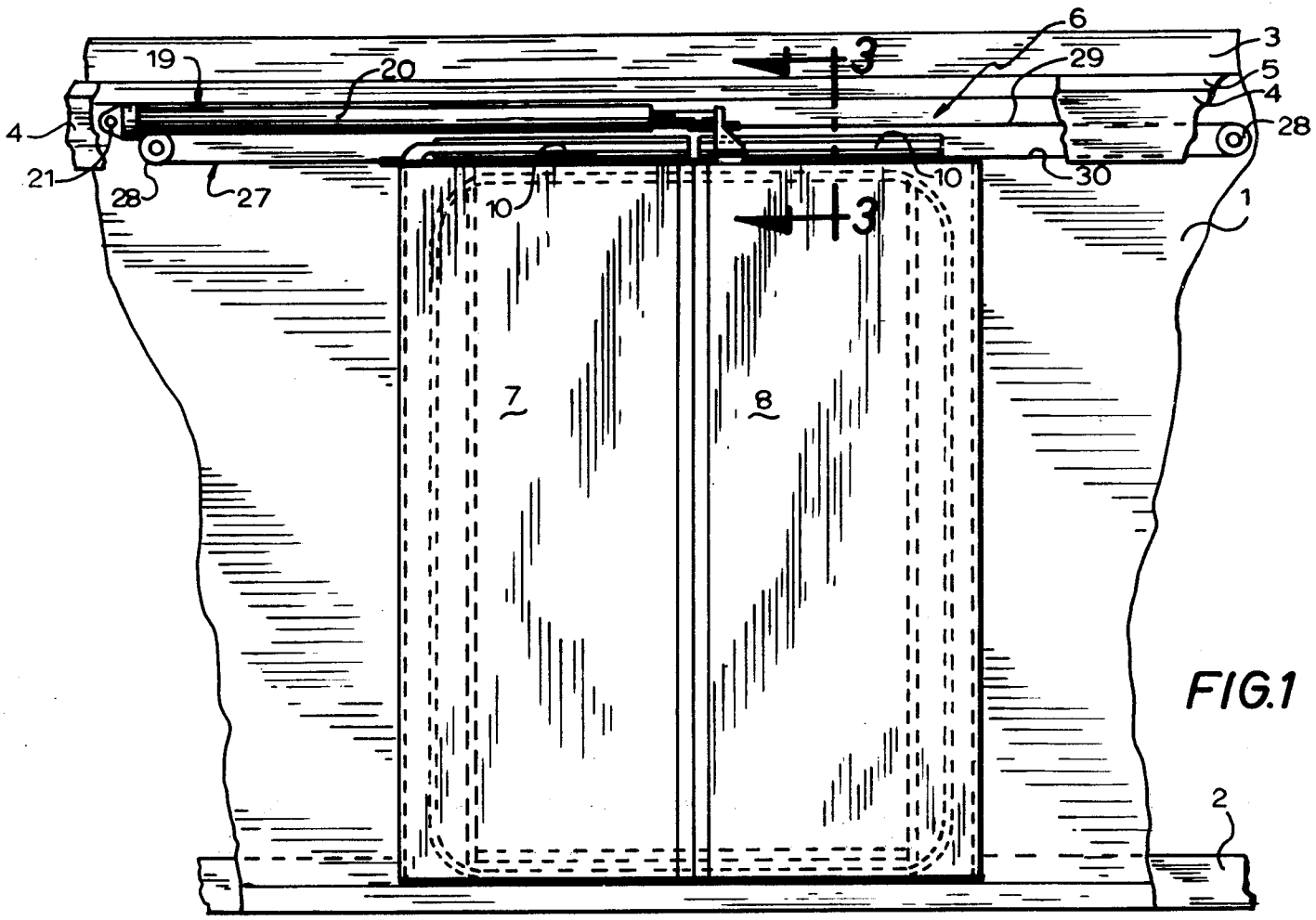
FIG. 1 is a front elevation view of a pair of sliding doors shown in closed position relative to a passageway through a side wall of a rapid transit passenger car and in combination with a door closure and hanger system according to the present invention.

The slidable door closure and hanger system of the present invention is adapted for a pair of oppositely slidable doors of a passenger vehicle such as a bus or preferably a railway passenger car for an urban transit system.

In the drawings, the railway passenger car is represented by a skin 1 defining the side wall of the car, a side sill 2, a cant rail 3 extending lengthwise longitudinally of the passenger car along one lateral edge of the roof, and a side cover 4 extending lengthwise longitudinally of the passenger car and removably securable by an attachment flange 5 to the lower edge portion of the cant rail 3. Thus, the side cover 4 is selectively removable to gain access to the slidable door closure and hanger system which is positioned in the longitudinal space 6 cooperatively formed over the slidable doors 7 and 8 by the side cover 4 and the side wall of the car.

The slidable door closure and hanger system according to the present invention includes a door closure connected to a door hanger to operatively slide the doors 7 and 8 to and fro edgewise relative one to the other.

The door hanger according to the present invention comprises a pair of slide track units extending lengthwise longitudinally of the passenger car each substantially coextensive with half the width of the passageway aperture 9. Each slide track unit includes a stationary movable track member 10, a carrier track member 11, a movable intermediate track member 12, and bearing balls 13. The stationary track member 10 is fixedly secured flat against the outside of the skin 1. Each movable track member 11 is laterally juxtaposed to and outward of a movable intermediate track member 12 and the bearing balls 13 are arranged in overlying runs on both sides of the movable intermediate member 12.

Figures 2, 3, 4, 5:
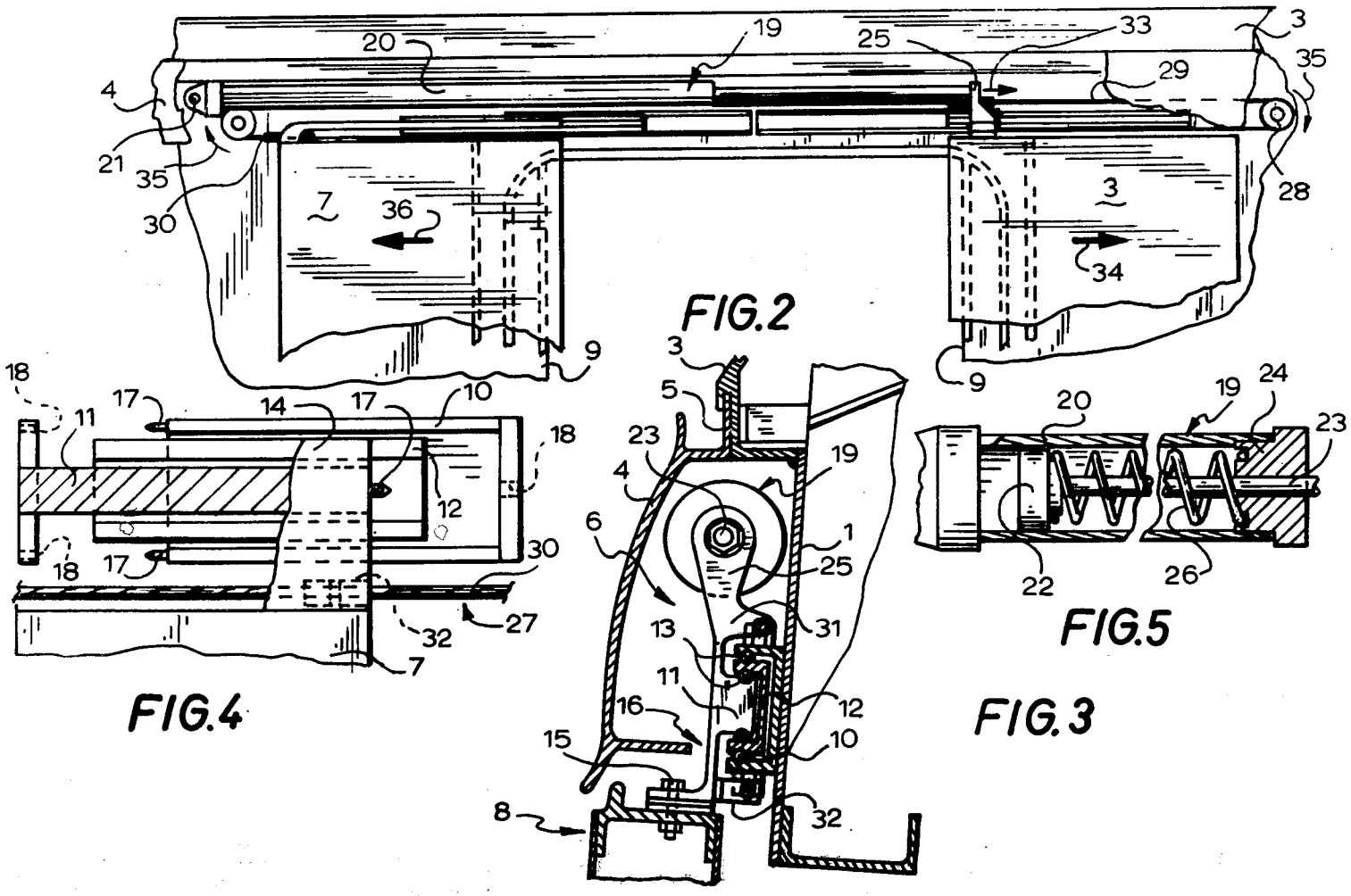
FIG. 2 is a front elevation view as in FIG. 1 but showing only the upper portion of the sliding doors with the latter in open position and in combination with the door closure and hanger system.
FIG. 3 is a cross-sectional view as seen along line 3—3 in FIG. 1.
FIG. 4 is a front elevation view of a slide track unit constituting the door hanger for one door.
FIG. 5 is a longitudinal cross-sectional view through the pneumatic cylinder actuator forming part of the door closure.

The door 7 is connected to the corresponding movable track member 11 by a bracket 14 of L shape cross-section. The bracket 14 has a baseplate portion secured flat on the upper edge of the sliding door and an upstanding plate portion integrally formed with the movable track 11 which projects from the inner side thereof. Thus, the door 7 is fixedly secured to the corresponding movable track member 11 for bodily sliding therewith. As shown in FIG. 3, the screws, or bolts 15 allow to readily remove the door 7 without disturbing the bracket 14 or track member 11. Similarly, the door 8 is removably secured by bolts or screws 15 to the base plate portion of a bracker 16 which is, as bracket 14, also integrally formed with the corresponding movable track member 11. Thus, the door 8 also bodily slides with the corresponding movable track member 11.

Each slide track unit, as shown in FIG. 4, is provided with unloading pins 17 which project endwise from the inner end of the stationary and the movable track members 10 and 11 and operatively engage endwise into corresponding bores 18 provided in the outer end of the slide members and in registry therewith. Thus, when the doors 7 and 8 close, the unloading pins 17 engage in the corresponding bores 18 to unload or release the load of the doors on the bearing balls 13.

The door closure according to the present invention and shown in FIGS. 1, 2, and 5 includes a pneumatic cylinder actuator 19 which extends lengthwise longitudinally of the railway passenger car. The pneumatic cylinder actuator 19 includes a pneumatic cylinder 20 which has its closed end pivoted at 21 to the side wall of the car. A piston 22 is mounted in the cylinder 20. A piston rod 23 is fixed at its inner end to the piston and extends endwise through a bearing plug 24 at the open end of the cylinder 20. The outer end of the piston rod 23 is connected to a bracket 25 which is fixed to the bracket 16 as an upward extension thereof to be bodily displaceable with the door 8. A compression or return spring 26 is coiled around the piston rod 23 in abutment between the piston 22 and the plug 24 to axially bias the piston rod inward or to the left as seen in FIGS. 1, 2 and 5. The spring 26 is thus adapted to contract the pneumatic cylinder actuator 19 and thus slide the door 8 in closing direction. The opening course of the door 8 is produced by increasing the air pressure in the cylinder 20 on the opposite side of the piston 22 relative to the piston rod 23.

The use of air pressure to produce the opening course results in positive and fast opening as a desirable to avoid wasting time for each door operation cycle which would amount to substantial cumulated time waste on a long run.

The spring closing is particularly advantageous to achieve a higher rate and force of closing at the beginning followed by a lower rate and force of closing at the end of the closing course. This provides a safety feature against injury to any passenger getting caught by the doors.

An endless cable 27 is provided to interconnect the two doors 7 and 8 and to concurrently slide the latter to and fro relative to each other. This cable is wound around a pair of pulleys 28 to define an upper cable run 29 and a lower cable run 30. The upper cable run 29 is attached to a bracket 31 which is secured against the rear of the upward extension 25. The lower run 30 of the cable is attached to a bracket 32 which is secured against the rear of the bracket 14 of door 7 attachment. Thus, the extension of the pneumatic cylinder actuator 19 by the bracket 31 pulls on the cable 27 in the direction of the arrows 33, 34 in FIG. 2. This causes the cable to be pulled around the pulleys 28 as indicated by the arrows 35. Thus, the lower run 30 is pulled in the opposite direction relative to the upper run and both doors 7 and 8 slide in opposite directions as indicated by the arrows 34 and 36.

Obviously, when the spring 26 is allowed to inwardly retract the pistion rod 23, the reverse movements or displacements occur and the doors 7 and 8 simultaneously close.

What is claimed is:

1. A slidable door closure and hanger system adapted to displace a sliding door along a wall in a path extending transversely relative to a door aperture in the wall, said slidable door closure and hanger system comprising an elongated slidable door closure and an elongated slidable door hanger each extending longitudinally of said path wholly above said door aperture, said slidable door closure including a fluid actuated cylinder unit extending longitudinally along said path and including a cylinder, a piston slidable in said cylinder, and a piston rod attached to said piston and slidable through one end of the cylinder, one of said cylinder and piston rod being connected to said wall, the other of said cylinder and piston rod being connected to said door and bodily displaceable therewith, and a return spring coiled around said piston rod in said cylinder, operatively biasing the piston rod and said door in a closing direction opposite to the opening direction produced by fluid actuation of the piston and constructed and arranged for reduced closure force in the spring at the end of the closing operation and unhurting impact by the closure force, said slidable door hanger comprising a slide track unit including a stationary track member, a movable door carrier track member, a movable intermediate track member, and bearing balls operatively mounted and retained between said movable intermediate track member and said stationary and said movable track members respectively, said stationary track member being fixedly secured relative to said wall above said door aperture and extending longitudinally along said door substantially co-extensive with the width of the door aperture covered by said door.

2. A slidable door closure and hanger system as defined in claim 1, wherein said slide track unit includes unloading projections longitudinally projecting from one of the track members and operatively engageable with another of said track members and relieveing the load of the door on the corresponding bearing balls upon closing of the door.

3. A slidable door closure and hanger system as defined in claim 1, wherein said slide track unit is fixed against said wall with said balls arranged in overlying runs and said track members being laterally juxtaposed relative to each other.

4. A slidable door closure and hanger system as defined in claim 3, further comprising said sliding door and another sliding door slidable edgewise to and fro relative to each other and defining said sliding path, another slide track unit including another stationary track member, another movable door carrier track member and another movable intermediate track member, and other bearing balls operatively mounted and retained by said another movable intermediate track member between said another stationary and said another movable door carrier track members, and an interconnecting endless connector defining parallel runs longitudinally extending along said sliding path, attached to said door carrier track members respectively, and producing sliding of said doors in opposite directions.

5. A slidable door closure and hanger system as defined in claim 4, wherein said slide track units include each unloading projections longitudinally projecting from one of the track members thereof and operatively engageable with another of the track members thereof and relieving the load on the corresponding bearing balls upon closing of the corresponding door.

6. In a passenger vehicle having a side wall, a passageway aperture through said side wall, and a pair of slidable doors displaceable to and fro relative to each other longitudinally and externally of said side wall between a closed position and an open position relative to said passageway aperture, a pair of slide track units mounted above said doors externally of said side wall, and each including a stationary track member, a movable door carrier track member, a movable intermediate track member, and bearing balls, the stationary track members being fixedly secured against the outisde of said wall and extending lengthwise longitudinally of said side wall substantially co-extensive with the width of the passageway aperture, each movable door carrier track member being laterally juxtaposed to and outward of a corresponding movable intermediate track member, said doors being attached to the movable door carrier track members respectively and bodily displaceable to and fro therewith, said slide track units include each unloading projections longitudinally projecting from one of the track members thereof and operatively engageable with another of the track members thereof and relieving the load on the corresponding bearing balls upon closing of the corresponding door, a pneumatic cylinder unit including a cylinder, a piston in said cylinder, a piston rod, and a return spring, and extending lengthwise longitudinally of said side wall above said slide track units, said pneumatic cylinder having one end thereof connected to said side wall and protracting longitudinally outward from the outer side edge of one of said doors, said piston rod being connected to said piston, slidably extending through the other end of said cylinder, and having the outer end thereof connected to the door carrier track member of the other of said doors, said return spring constituting a compression spring coiled around said piston rod inside said cylinder and operatively biasing said piston, piston rod, and other door in a closing direction toward said one door, an interconnecting cable winded around a pair of pulleys and defining a lower run and an upper run attached to said movable door carrier track members respectively whereby pneumatic opening and spring closing actions by the pneumatic cylinder unit produce concurrent opening and closing respectively of the slidable doors.

* * * * *